US006449985B1

(12) United States Patent
Kejejian

(10) Patent No.: US 6,449,985 B1
(45) Date of Patent: Sep. 17, 2002

(54) DIAMOND CUT

(75) Inventor: Toros Kejejian, Los Angeles, CA (US)

(73) Assignee: Tycoon, Los Angeles, CA (US)

( * ) Notice: Subject to any disclaimer, the term of this patent is extended or adjusted under 35 U.S.C. 154(b) by 0 days.

(21) Appl. No.: 09/662,497

(22) Filed: Sep. 14, 2000

(51) Int. Cl.[7] ..... A44C 17/00
(52) U.S. Cl. ..... 63/32; D11/89; D11/90
(58) Field of Search ..... 63/32; D11/89, D11/90

(56) References Cited

U.S. PATENT DOCUMENTS

| | | | | | |
|---|---|---|---|---|---|
| 138,314 | A | * | 4/1873 | Bruhl | 63/32 |
| D58,318 | S | * | 7/1921 | Heller | D11/90 |
| D59,298 | S | * | 10/1921 | Steel | D11/90 |
| D59,299 | S | * | 10/1921 | Steel | D11/90 |
| D81,382 | S | * | 6/1930 | Dinhofer | D11/90 |
| 2,143,084 | A | * | 1/1939 | Nirenstein | 63/32 |
| 2,265,316 | A | * | 12/1941 | Schenck | 63/32 |
| 4,020,649 | A | | 5/1977 | Grossbard | |
| D251,659 | S | | 4/1979 | Grossbard | |
| 5,186,024 | A | * | 2/1993 | Waters, Jr. | 63/32 |
| D360,376 | S | * | 7/1995 | Kaplan | D11/90 |
| D391,518 | S | * | 3/1998 | Slowinski et al. | D11/90 |
| 5,970,744 | A | | 10/1999 | Greeff | |
| D426,488 | S | * | 6/2000 | Dobashi | D11/90 |
| D429,475 | S | * | 8/2000 | Steinberg | D11/90 |

FOREIGN PATENT DOCUMENTS

| | | |
|---|---|---|
| SU | 1743563 | 6/1992 |

* cited by examiner

*Primary Examiner*—Jack Lavinder
*Assistant Examiner*—Andrea Chop
(74) *Attorney, Agent, or Firm*—Stephen E. Feldman, P.C.

(57) ABSTRACT

A mixed cut gemstone having a brilliant cut crown, a girdle and a step cut pavilion. The step cut pavilion contains four rib lines running from the girdle to a culet, which can be a line or a point. These rib lines subdivide the pavilion into four sides, which, if the girdle is shaped like a square, are equivalent, and, if the girdle is shaped like a rectangle, then any two opposing sides are equivalent. The pavilion contains a multitude of steps, which add to an elegant and classic look of the gemstone. The crown contains a flat table in a form of a diamond, four corner facets and four upper girdle facets, thus, creating superior factors of dispersion, brilliance and scintillation. The table is slightly elevated due to the angles that the four corner facets and four upper girdle facets form with the girdle.

17 Claims, 4 Drawing Sheets

DIAMOND CUT

FIELD OF THE INVENTION

The present invention is directed towards a gemstone cut. Specifically, the present invention is directed towards a mixed cut gemstone with a brilliant cut crown, a girdle and a step cut pavilion. The crown in the present invention contains a flat table and a number of corner and upper girdle facets. The pavilion contains four rib lines subdividing the pavilion into four parts.

BACKGROUND OF THE INVENTION

There are a variety of step, brilliant and mixed cut gemstone cuts, however, there are several problems that the prior art presents and furthermore the prior art does not address the particular need for the better gemstone cut that has superior combination of factors for scintillation, dispersion, and brilliancy. There is a long felt but unfulfilled need for a better gemstone cut that achieves best possible results for brilliancy, dispersion and scintillation.

There are several U.S. and foreign patents available, however, all of them present certain problems and do not fulfill the need for a better gemstone cut.

U.S. Pat. No. 5,970,744 to Greeff discloses a mixed cut gemstone having step cut crown with two steps and a flat table, a girdle and a pavilion. The crown and the pavilion are substantially square in shape and corners being a third of a side length. The pavilion sides and corners have rib lines that extend from the girdle to the gemstone's culet. Each pavilion side has four facets divided. The gemstone is a combination of a step cut crown and a brilliant cut pavilion. The present invention is substantially different from this prior art. The present invention has a brilliant cut crown and a step cut pavilion. The prior art contains steps in its table, whereas the present invention has a brilliant cut crown without any steps. The pavilion of the prior art is brilliant cut without any steps, whereas the present invention contains a step cut pavilion with several steps. The features of the present invention allow it to achieve superiority over the prior art in terms of physical characteristics of a cut gemstone, such as scintillation, dispersion and brilliancy.

U.S. Pat. No. 4,020,649 to Grossbard discloses step cut stone with polygonal shaped girdle and a pyramidal base. The crown contains at least table and girdle breaks, where some of the breaks contain triangular shaped facets. The present invention contains a step cut pavilion and a brilliant cut crown. Moreover, the present invention contains greater number of steps in its pavilion, rather than this particular prior art.

U.S. Pat. No. Des. 251,659 to Grossbard disclose a mixed cut diamond having a step cut crown with a flat table, a brilliant cut pavilion having a multitude of facets with rib lines dividing sides and corners and a point culet, unlike the present invention which has a line culet. Each corner and side contains at least four facets, including lower girdle facets and bezel stars. The present invention is a mixed cut gemstone with brilliant cut crown and a step cut pavilion. The present invention's crown does not contain any steps and its pavilion does not contain a bezel star, as in the case of this prior art.

U.S. Pat. No. Des. 391,518 to Slowinski et al. discloses a mixed cut gemstone with a square shaped crown having a polygon shaped table, table and girdle breaks with multiple facets (including upper girdle facets, bezel star facets and lower table side facets). The gemstone has brilliant cut pavilion with rib lines running from the girdle to the culet point. The sides of the pavilion have several facets, including lower girdle facets and bezel star facets. The present invention has a brilliant cut crown and a step cut pavilion, which significantly differs from the prior art.

Russian Patent No. SU 1743563-A1 discloses a mixed cut diamond with trapezoidal shaped faces on both the crown and the pavilion. The rib lines subdividing faces on the pavilion run from the girdle to the culet line. The present invention substantially differs because of having a step cut pavilion with several steps and a brilliantized crown.

While the prior art is of significant interest, it does not address a specific need of a particular way to have a mixed gemstone cut, that would achieve best possible coefficients for brilliancy, dispersion and scintillation. The present invention achieves that need by providing a mixed cut gemstone with brilliant cut crown and a step cut pavilion that has superior coefficients of brilliancy, dispersion and scintillation.

SUMMARY OF THE INVENTION

The present invention is directed toward a gemstone cut.

The main object of the present invention is to create a mixed cut gemstone with a brilliant cut crown and a step cut pavilion.

It is another object of the present invention to create a mixed cut gemstone having a brilliant cut crown, which provides for a good dispersion and scintillation.

It is another object of the present invention to create a mixed cut gemstone with a step cut pavilion.

It is another object of the present invention to create a mixed cut gemstone having a brilliant cut crown and a step cut pavilion having superior coefficients of dispersion and scintillation.

It is another object of the present invention to create a mixed cut gemstone having a limited number of faces in its crown yet achieving best results for dispersion, scintillation and brilliancy.

It is another object of the present invention to create a mixed cut gemstone with a crown having a flat table, four corner facets and four upper girdle facets.

It is another object of the present invention to create a mixed cut gemstone with multiple step cut pavilion having a point culet.

It is another object of the present invention to create a mixed cut gemstone with multiple step cut pavilion having a line culet.

It is another object of the present invention to create a mixed cut gemstone with a rectangular shaped girdle that provides for superior coefficients of dispersion, scintillation and brilliancy.

It is another object of the present invention to create a mixed cut gemstone with a square shaped girdle that provides for superior coefficients of dispersion, scintillation and brilliancy.

It is another object of the present invention to create a mixed cut gemstone with a diamond shaped table that provides for the best results in dispersion and brilliancy.

It is another object of the present invention to create a mixed cut gemstone with a diamond shaped table that is slightly elevated from the girdle plane.

It is another object of the present invention to create a mixed cut gemstone with its pavilion having four rib lines that divide the pavilion into four parts.

It is another object of the present invention to create a mixed cut gemstone with a rectangular shaped girdle where girdle length is about twice the girdle width.

Other objects will become apparent from the foregoing description.

BRIEF DESCRIPTION OF THE DRAWINGS

The following description of preferred embodiments of the present invention will be better understood when read in conjunction with the appended drawings. It should be understood, however, that the invention is not limited to the precise arrangements shown in which.

DESCRIPTION OF THE PREFERRED EMBODIMENT

Figure 1:
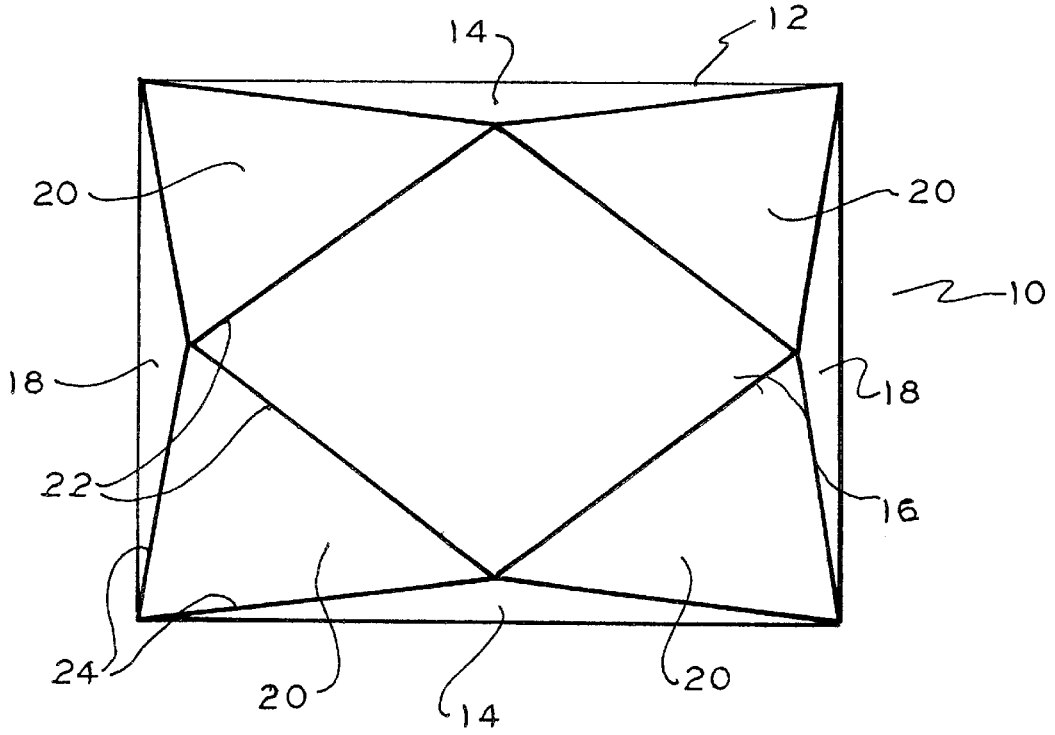
FIG. 1 is a perspective view of the top of the gemstone cut showing a crown with a flat table and crown faces.

The present relates to a new gemstone cut. Specifically the present invention is directed toward a mixed cut gemstone having a brilliant cut crown and a step cut pavilion. The present invention would be better understood in conjunction with following descriptions of preferred embodiments. However, it is understood by one skilled in the art that the present invention is not limited to the scope of those specific embodiments, but instead restricted to the above referenced prior art and the appended claims. It is understood by one skilled in the art that other embodiments are possible as long as they are within the spirit and scope of the following claims.

In the following description, the reference to drawings and specific terms are used for clarity and conciseness. It is assumed by one skilled in the art that there are to be no unnecessary limitations to be implied from such terms or references. Furthermore, the descriptions and drawings are for illustrative purposes only and the present invention is not limited to the exact details shown, described or represented.

There are several well-known types of gemstone cuts, which serve as a distinguishing characteristic in classifying the gemstones. Among those are a step cut, a brilliant cut and mixed cut. A step cut, while lacking dispersion capacities of the brilliant cut, achieves elegant and classic looks of the gemstone. The step cut can be distinguished by long facets, called "steps", arranged parallel to the girdle. On the bottom the number of facets is indeterminable and the crown usually has two steps. The brilliant cut has no steps and achieves excellent brilliancy and dispersion coefficients while compromising elegance and classic looks of the step cut. Finally, as a combination of the both brilliant and step cuts there is a mixed or hybrid cut, which attempts to achieve the elegant and classic looks without compromising brilliancy and dispersion factors.

Moreover, the gemstones are also described in terms of dispersion, brilliancy and scintillation. Dispersion is separation of light into seven wavelengths when light passes through the surface of the gemstone. Dispersion cannot be seen when the surfaces (i.e., facets), through which light travels, are parallel to each others, because the light rays converge, when they pass through the surfaces. Brilliancy refers to the brightness of the stone, thus, relating to the surface polish of the stone and the internal reflection of light from back facets. Scintillation refers to the flashing of light from the facets of the stone when the stone is turned or the observer of the stone is in motion. Scintillation depends on several factors. Among those are a number of facets, the quality of polish and the brilliancy of the stone.

In one embodiment of the invention, referring to FIGS. 1 through 4, a gemstone 10 is shown from the top. The gemstone 10 is depicted with a rectangular shaped crown 12 with a flat table 16, four corner facets 20, long side upper girdle facets 14 and short side upper facets 18. The width of the crown 12, along which upper girdle facets 18 are aligned, is about 50% the size of the length of the crown 12, along which upper facets 14 are aligned. The table 16 is separated from the corner facets 20 using the table break lines 22. Lines 22 create a diamond like shape of a table, thus providing for much better dispersion and scintillation coefficients. The corner facets 20 are separated from the upper girdle facets 14 and 18 using girdle break lines 24.

The upper girdle facets 18 form about 40° to 50° angles with the girdle plane and the upper girdle facets 14 form about 45° to 55° angles with the same plane. The corner facets 20 form analogous angles with the girdle plane. One set of corner angles of table 16 are about twice the size of the other set of corner angles.

Figure 2:
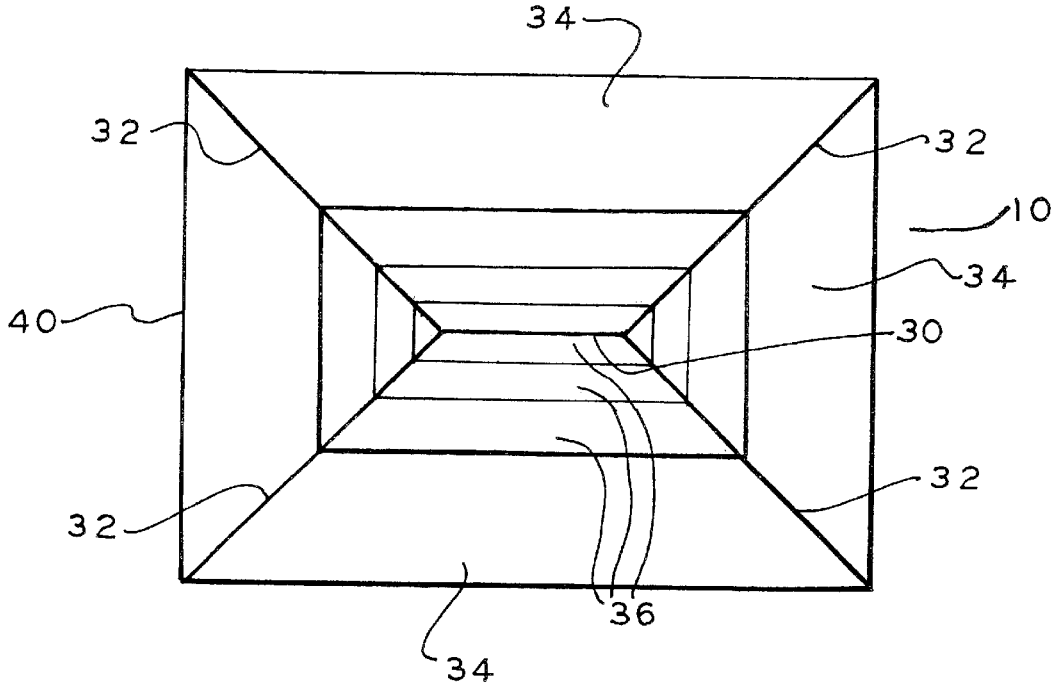
FIG. 2 is a perspective view of the bottom of the gemstone cut showing pavilion step cuts and a line culet.
Figure 3:
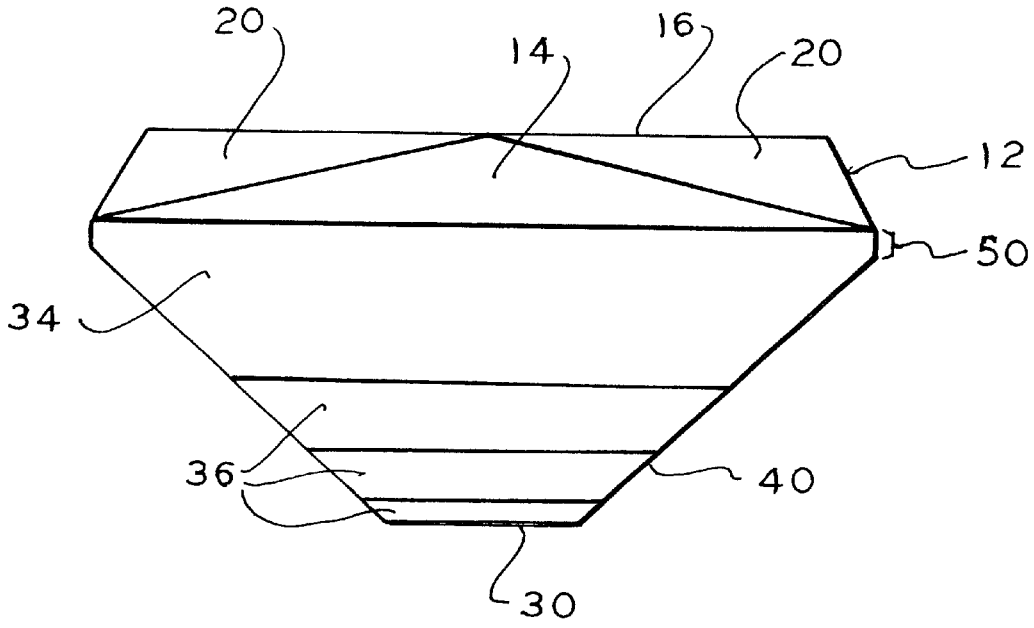
FIG. 3 is a side view of the gemstone cut from the long side of the gemstone.
Figure 4:
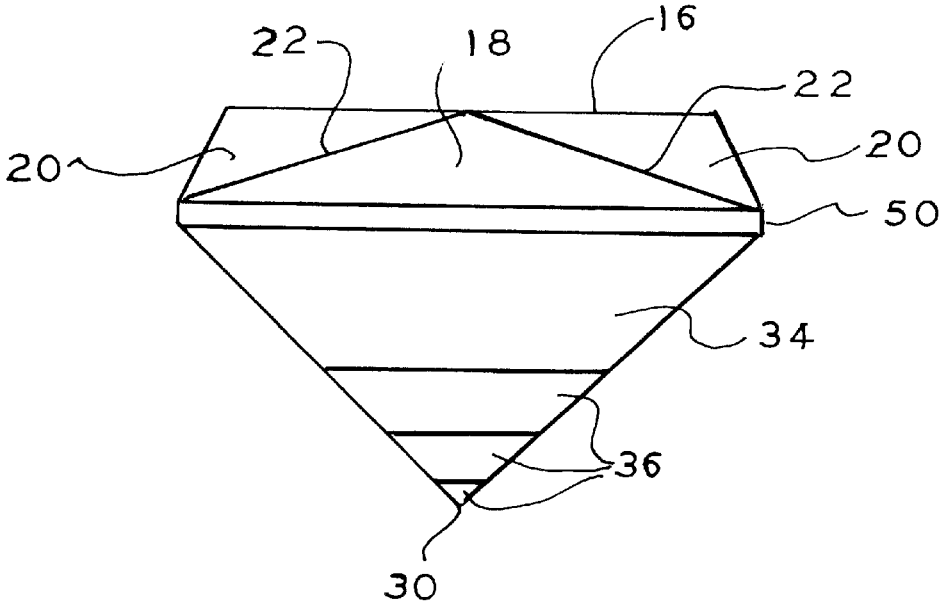
FIG. 4 is a side view of the gemstone cut from the shorter side of the gemstone

Referring to FIG. 2, the gemstone cut 10 is shown from the bottom. The gemstone cut 10 has a pavilion 40, step cuts 36 and a lower girdle face 34. The steps are almost equal in width, except for the lower girdle faces 34, which are larger in width. In this particular embodiment, the gemstone cut 10 has a culet line 30. The steps 36 and the lower girdle 34 form approximately 45-degree angle with the girdle plane. These are formed using the rib lines 32. Referring to FIGS. 3 and 4, the gemstone cut 10 is shown from a side view, exposing crown 12, girdle 50 and pavilion 40. The girdle 50 has a depth of about $1/20^{th}$ the length of the girdle 50. The depth of the crown 12 is about $1/10^{th}$ of the length of the girdle 50 and the depth of the pavilion 40 is approximately $1/4^{th}$ of the length of the girdle. The angle between that the longer sides of the pavilion 40 form is approximately 30°.

Figure 5:
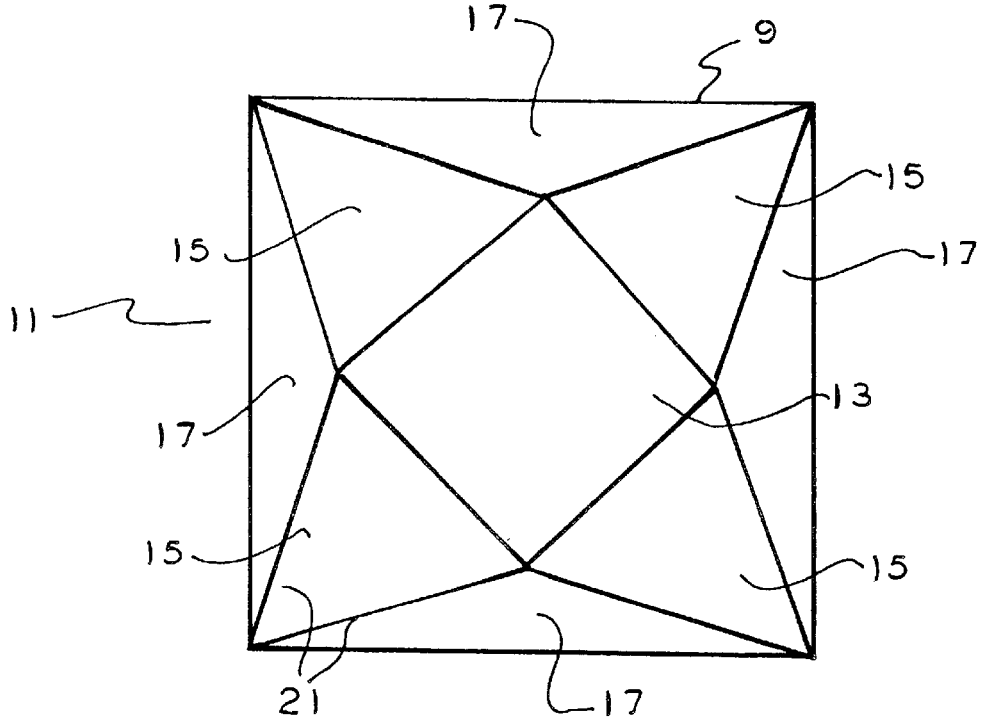
FIG. 5 is a perspective view of another embodiment of invention where the gemstone is cut with a square girdle, four corner facets and four upper girdle facets.
Figure 6:
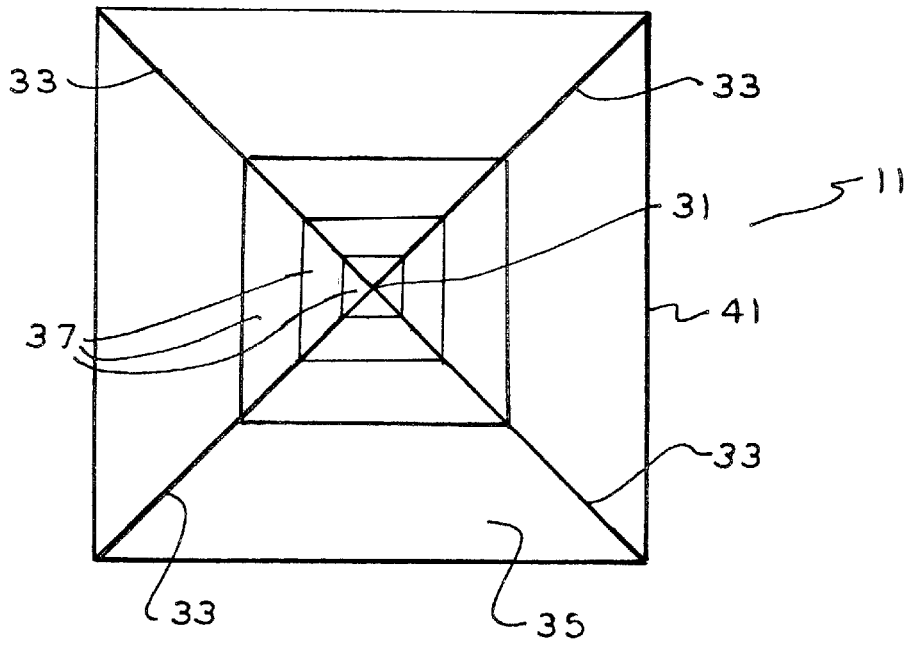
FIG. 6 is perspective view of the bottom of the gemstone cut of FIG. 5 showing pavilion step cuts and a point culet.

In another embodiment, shown in FIG. 5, the gemstone 11 is shown with a crown 9 having square shaped form, a flat table 13 also in a shape of a square, four corner facets 15 and four upper girdle facets 17. The area of the flat table 13 and table 16 in FIG. 1 is approximately $1/4^{th}$ of the area base of the crown 9 the girdle. The four corner facets are equal in area. Analogously, the four upper girdle facets are equivalent in area. FIG. 6 depicts a bottom view of the gemstone 11 having a pavilion 41 having step cut facets 37 and a lower girdle facet 35. All of the facets having step cut lines, which, in a projection, form a square. The pavilion 41 has a point culet 31 where rib lines 33 converge.

Figure 7:
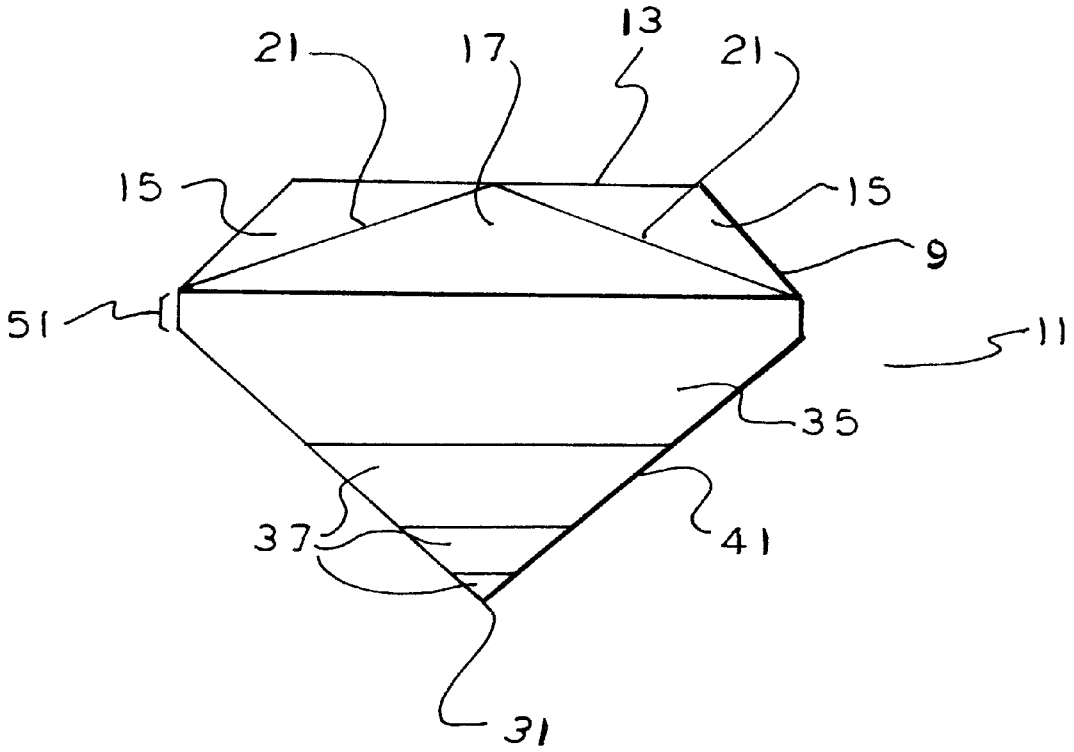
FIG. 7 is a side view of the gemstone cut of FIG. 5.

The gemstone 11 has a crown 9, girdle 51 and pavilion 41, as shown in FIG. 7. The rib lines of the pavilion together with the girdle plane form a tetrahedron, with equivalent base angles that may be in a range of 30° to 60°.

The gemstones that may be used by the present invention are conventionally known precious or semi-precious stones such as diamonds, rubies or other well-known stones. The gemstone cut provides for the hybrid cut that allows for superior coefficients of dispersion, scintillation and brilliancy. The brilliant cut crown allows for superior dispersion of light. Moreover, because of the particular way the gemstone is cut, the brilliancy and scintillation of the gemstone is enhanced as compared with the prior art. When the light hits the table and facets of the crown it bends several times after reflecting of inner surfaces of the facets. Meanwhile, the step cuts of the pavilion provide parallel incoming and outgoing rays of light, making the gemstone appear more brilliant and scintillated. Because of the unique way that the gemstone in the present invention is cut, it gains significant advantages over the prior art. In the foregoing description of the invention, reference to the drawings, certain terms have been used for conciseness, clarity, and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented, or described.

While the present invention has been described with reference to specific embodiments, it is understood that the invention is not so limited but rather includes any and all changes and modifications thereto which would be apparent to those skilled in the art and which come within the spirit and scope of the appended claims.

What is claimed:

1. A mixed cut gemstone, comprising:

a) a pavilion, wherein said pavilion is step cut and comprises
- a multitude of step cuts, where said step cuts are arranged parallel to each other and are spaced;
- a lower girdle facet substantially wider than said step cuts; and
- rib lines, wherein said rib lines subdivide said pavilion into parts and end at a culet;

b) a girdle, wherein said girdle has a length and a width and comprises
- a crown break; and,
- a pavilion break; and, c) a crown where said crown is brilliant cut and comprises
- four corner facets, wherein said corner facets are shaped as triangles;
- four upper girdle facets, wherein said upper girdle facets are shaped as triangles; and,
- a table, wherein said table is in the form of a diamond with sides conjoining with said corner facets, and has vertices conjoining with said upper girdle facets.

2. The mixed cut gemstone of claim 1, where said culet is a line or a point.

3. The mixed cut gemstone of claim 1, wherein said corner facets have an inclination of 40 to 50 degrees of arc with respect to the plane of said girdle.

4. The mixed cut gemstone of claim 1, wherein said corner facets are identical to one another and are either equilateral or substantially isosceles triangles.

5. The mixed cut gemstone of claim 1, wherein the four said upper girdle facets have an inclination of 45 to 55 degrees of arc with respect to the plane of said girdle.

6. The mixed cut gemstone of claim 1, wherein opposite upper girdle facets are identical to one another and are either equilateral or substantially isosceles triangles.

7. The mixed cut gemstone of claim 1, where the length of said girdle is twice the width of said girdle.

8. The mixed cut gemstone of claim 1, where the length of said girdle is equal to the width of said girdle.

9. The mixed cut gemstone of claim 1, wherein said crown further comprises table breaks and girdle breaks:

a) said table breaks divide said table and said corner facets; and, b) said girdle breaks divide said upper girdle facets and said corner facets.

10.The mixed cut gemstone of claim 1, wherein said culet is a line and is approximately one half of the length of said girdle.

11. The mixed cut gemstone of claim 1, wherein a depth of said girdle is one-twentieth of the length of said girdle.

12. The mixed cut gemstone of claim 1, wherein a depth of said crown is one-tenth of the length of said girdle.

13. The mixed cut gemstone of claim 1, wherein said girdle has a depth of one-twentieth of the length of said girdle.

14. The mixed cut gemstone of claim 1, wherein said pavilion has a depth of one-fourth of the length of said girdle.

15. The mixed cut gemstone of claim 1, wherein said girdle has a depth of one-twentieth of the length of said girdle.

16. The mixed cut gemstone of claim 1 where the area of said table is substantially one-fourth of the area of the base of the crown.

17. A mixed cut gemstone comprising:

a) a pavilion, wherein said pavilion is step cut and comprises
- a multitude of step cuts where said step cuts are arranged parallel to each other and are spaced;
- a lower girdle facet substantially wider than said step cuts;
- rib lines, wherein said rib lines subdivide said pavilion into equal opposite parts and at a culet;

b) a girdle, wherein said girdle has a length and a width and comprises
- a crown break; and,
- a pavilion break;

c) a crown, where said crown is brilliant cut and comprises
- four corner facets, wherein said corner facets are shaped as triangles;
- four upper girdle facets, wherein said upper girdle facets are shaped as triangles;
- a table, wherein said table is in the form of a diamond with sides conjoining with said corner facets, and has vertices conjoining with said upper girdle facets; and, d) a table which is substantially one fourth of the area of the base of the crown.

* * * * *